US009161616B1

(12) United States Patent
Arishenkoff et al.

(10) Patent No.: US 9,161,616 B1
(45) Date of Patent: Oct. 20, 2015

(54) PORTABLE DESK ASSEMBLY

(71) Applicants: Michele Arishenkoff, Oakville (CA); Geoffrey Hicks, Oakville (CA); John Sickling, Oakville (CA)

(72) Inventors: Michele Arishenkoff, Oakville (CA); Geoffrey Hicks, Oakville (CA); John Sickling, Oakville (CA)

( * ) Notice: Subject to any disclaimer, the term of this patent is extended or adjusted under 35 U.S.C. 154(b) by 0 days.

(21) Appl. No.: 14/303,732

(22) Filed: Jun. 13, 2014

(51) Int. Cl.
*A47B 3/02* (2006.01)
*A47B 9/16* (2006.01)
*A47B 3/08* (2006.01)

(52) U.S. Cl.
CPC ..... *A47B 9/16* (2013.01); *A47B 3/0818* (2013.01)

(58) Field of Classification Search
CPC ..... A47B 9/16; A47B 3/02; A47B 2003/025; D06F 81/04
USPC ..... 108/120, 119, 116, 117, 118; 248/188.6, 188.2, 188.1, 243; 254/122
See application file for complete search history.

(56) References Cited

U.S. PATENT DOCUMENTS 262,206 A * 8/1882 Carr ..... 108/116
631,556 A * 8/1899 Bushnell ..... 108/117
916,341 A 3/1909 Lloyd
2,557,594 A * 6/1951 Bryan ..... 108/118
3,110,476 A * 11/1963 Farris ..... 254/122
3,147,748 A * 9/1964 Frank ..... 108/119
3,329,104 A 7/1967 Gittings
3,387,573 A * 6/1968 Abner ..... 108/117
4,168,669 A * 9/1979 Arnoff ..... 108/116
4,433,869 A * 2/1984 Payne et al. ..... 108/119
5,086,711 A * 2/1992 Matthews ..... 108/119
5,353,715 A * 10/1994 Luyk ..... 108/116
D448,948 S 10/2001 Wolff
D489,553 S 5/2004 Haney
7,640,869 B2 1/2010 Leng
8,424,470 B2 4/2013 Volin
8,950,343 B2 * 2/2015 Huang ..... 108/116
2002/0083870 A1 * 7/2002 Chen ..... 108/119
2004/0025759 A1 * 2/2004 Lee ..... 108/118
2011/0247530 A1 10/2011 Coffman
2012/0153098 A1 6/2012 Riach

FOREIGN PATENT DOCUMENTS

WO WO2005032303 2/2004

* cited by examiner

*Primary Examiner* — Jose V Chen

(57) ABSTRACT

A portable desk assembly for providing a work surface having an adjustable height includes a pair of stands each movably coupled together. The pair of stands is positionable between a deployed position and a stored position. A panel is coupled to the pair of stands. The panel may provide a work surface. A lock is coupled between the pair of stands. The lock retains the panel at a selected height when the pair of stands is positioned in the deployed position.

13 Claims, 5 Drawing Sheets

PORTABLE DESK ASSEMBLY

BACKGROUND OF THE DISCLOSURE

Field of the Disclosure

The disclosure relates to desk devices and more particularly pertains to a new desk device for providing a work surface having an adjustable height.

SUMMARY OF THE DISCLOSURE

An embodiment of the disclosure meets the needs presented above by generally comprising a pair of stands each movably coupled together. The pair of stands is positionable between a deployed position and a stored position. A panel is coupled to the pair of stands. The panel may provide a work surface. A lock is coupled between the pair of stands. The lock retains the panel at a selected height when the pair of stands is positioned in the deployed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
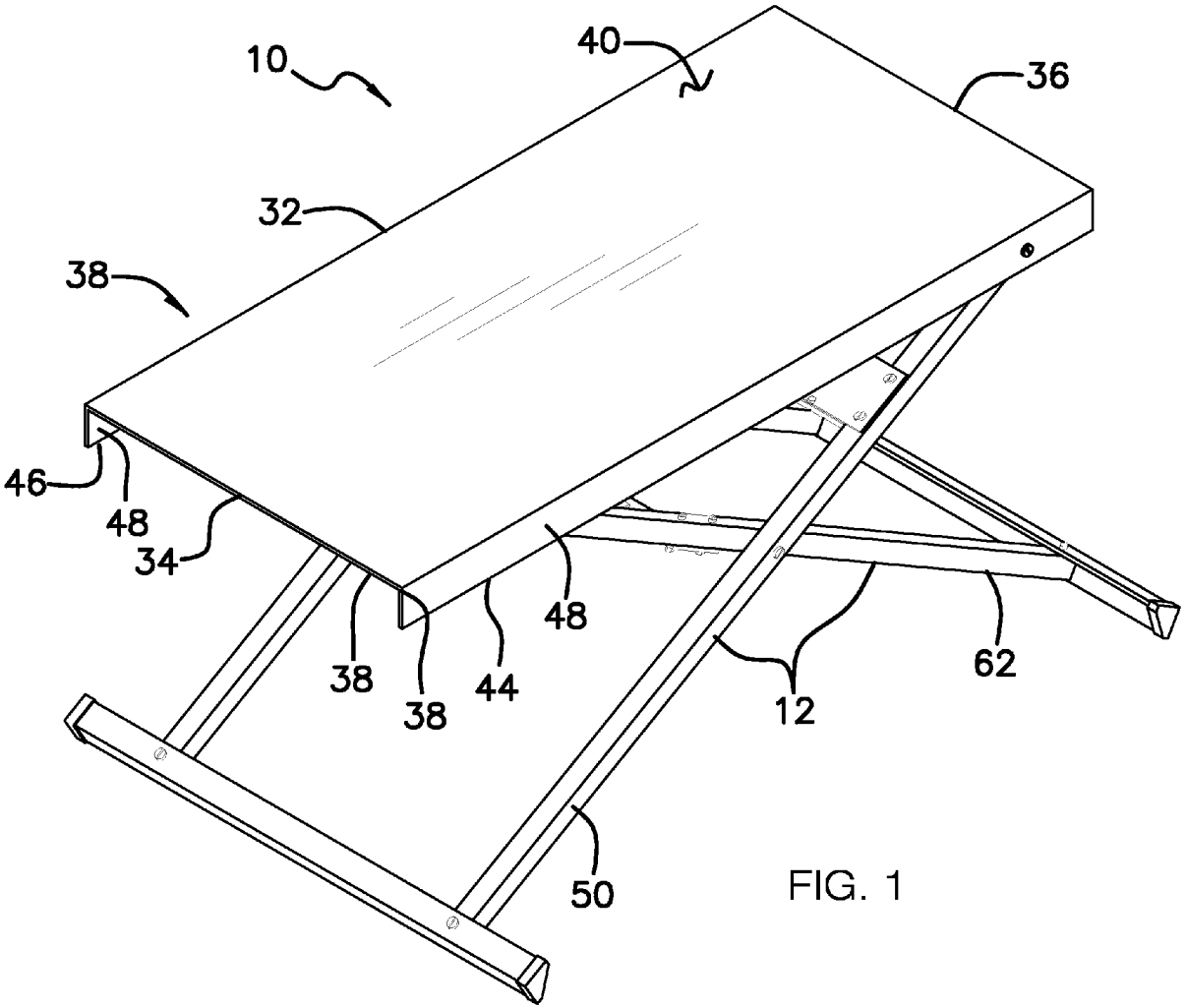
FIG. 1 is a top perspective view of a portable desk assembly according to an embodiment of the disclosure.
Figure 2:
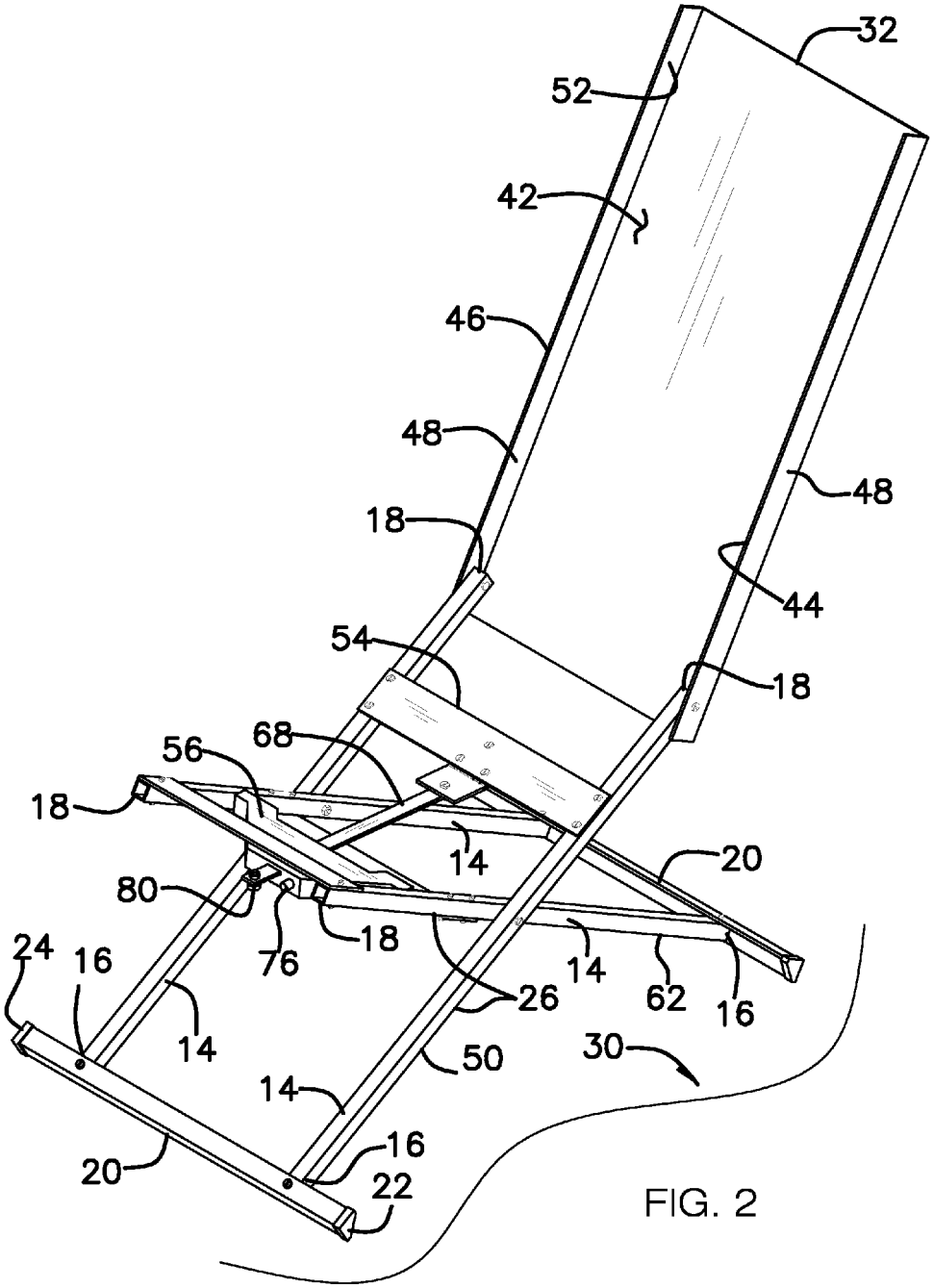
FIG. 2 is a front perspective view of an embodiment of the disclosure.
Figure 3:
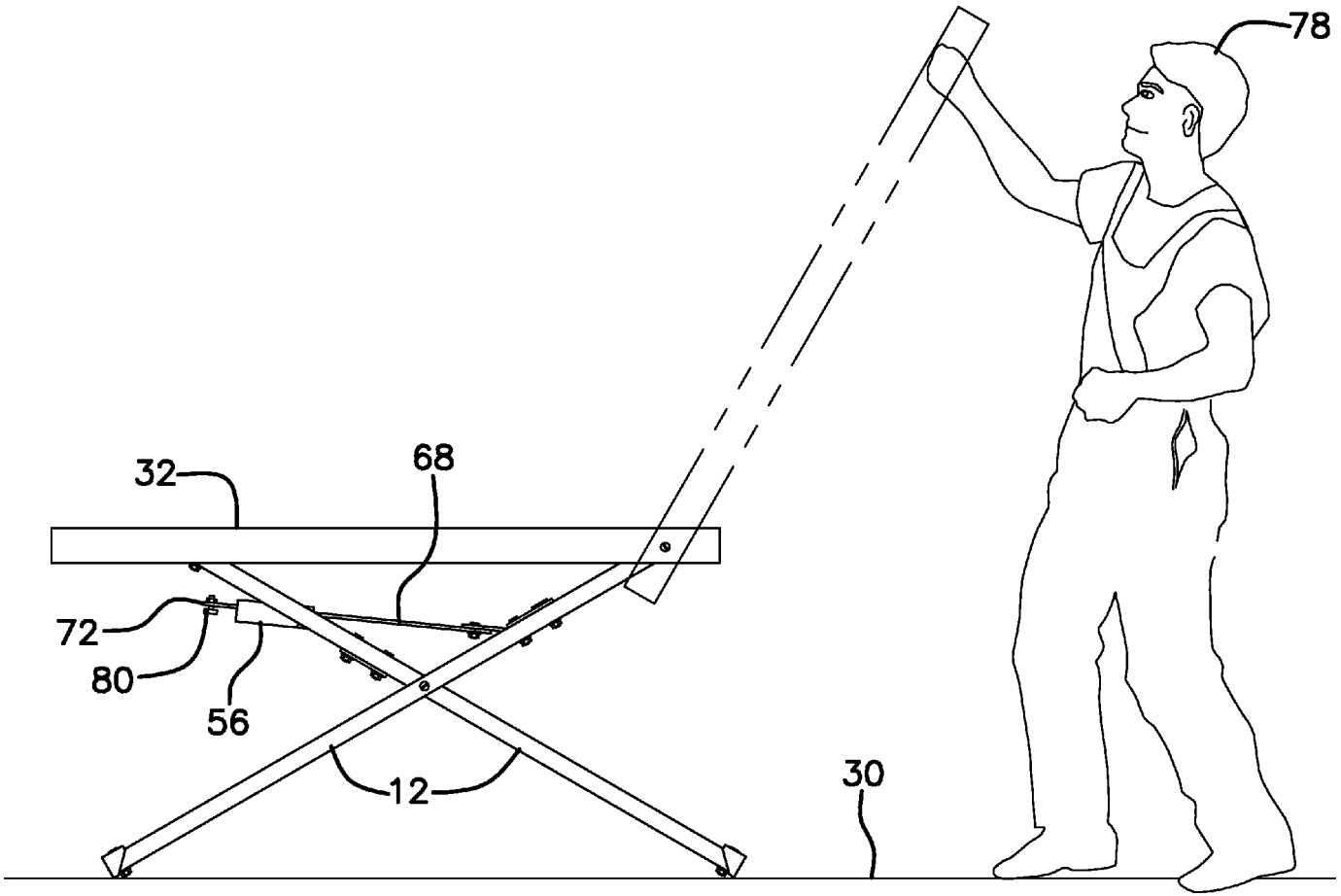
FIG. 3 is a front view of an embodiment of the disclosure.
Figure 4:
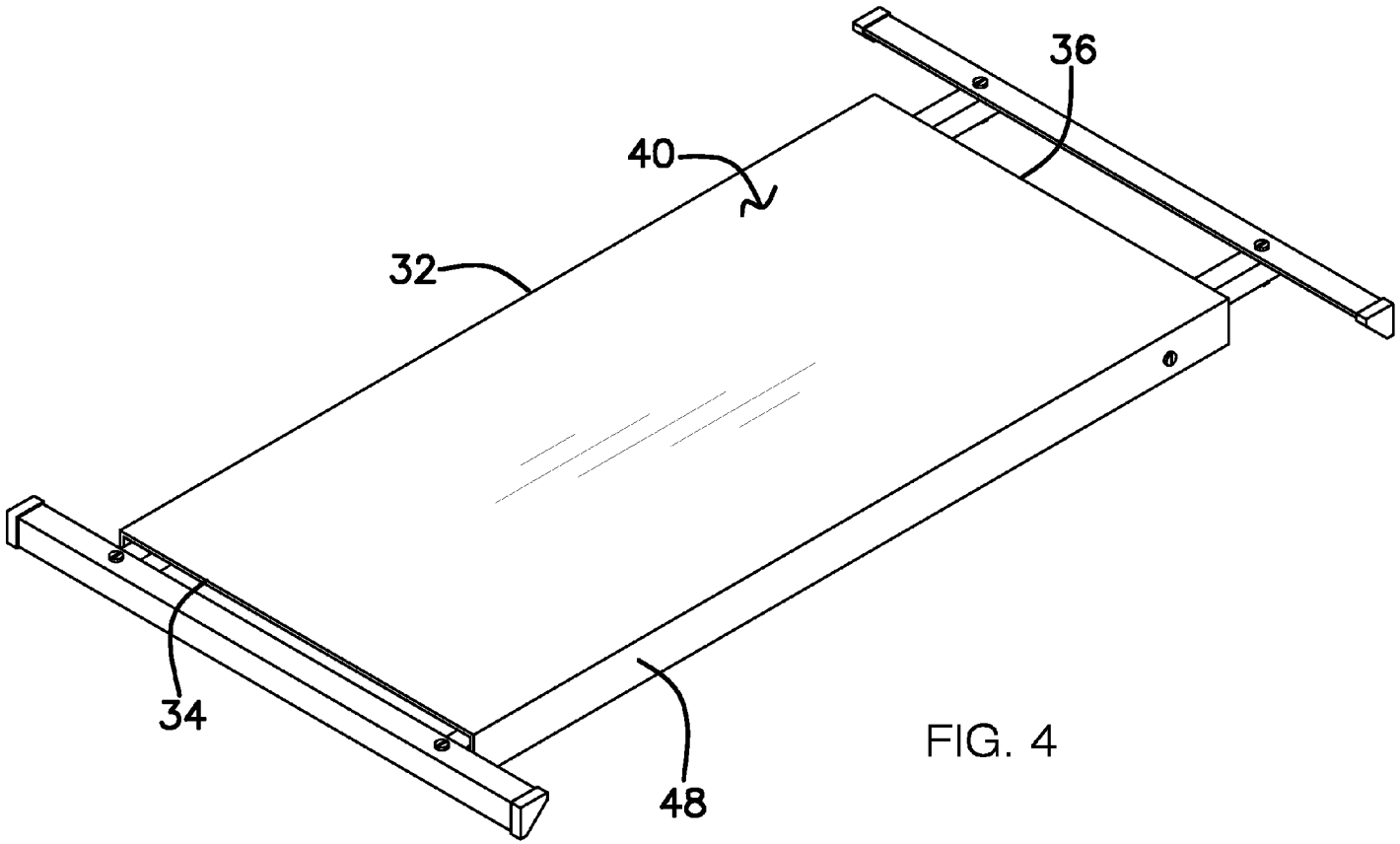
FIG. 4 is a perspective view of an embodiment of the disclosure in a stored position.
Figure 5:
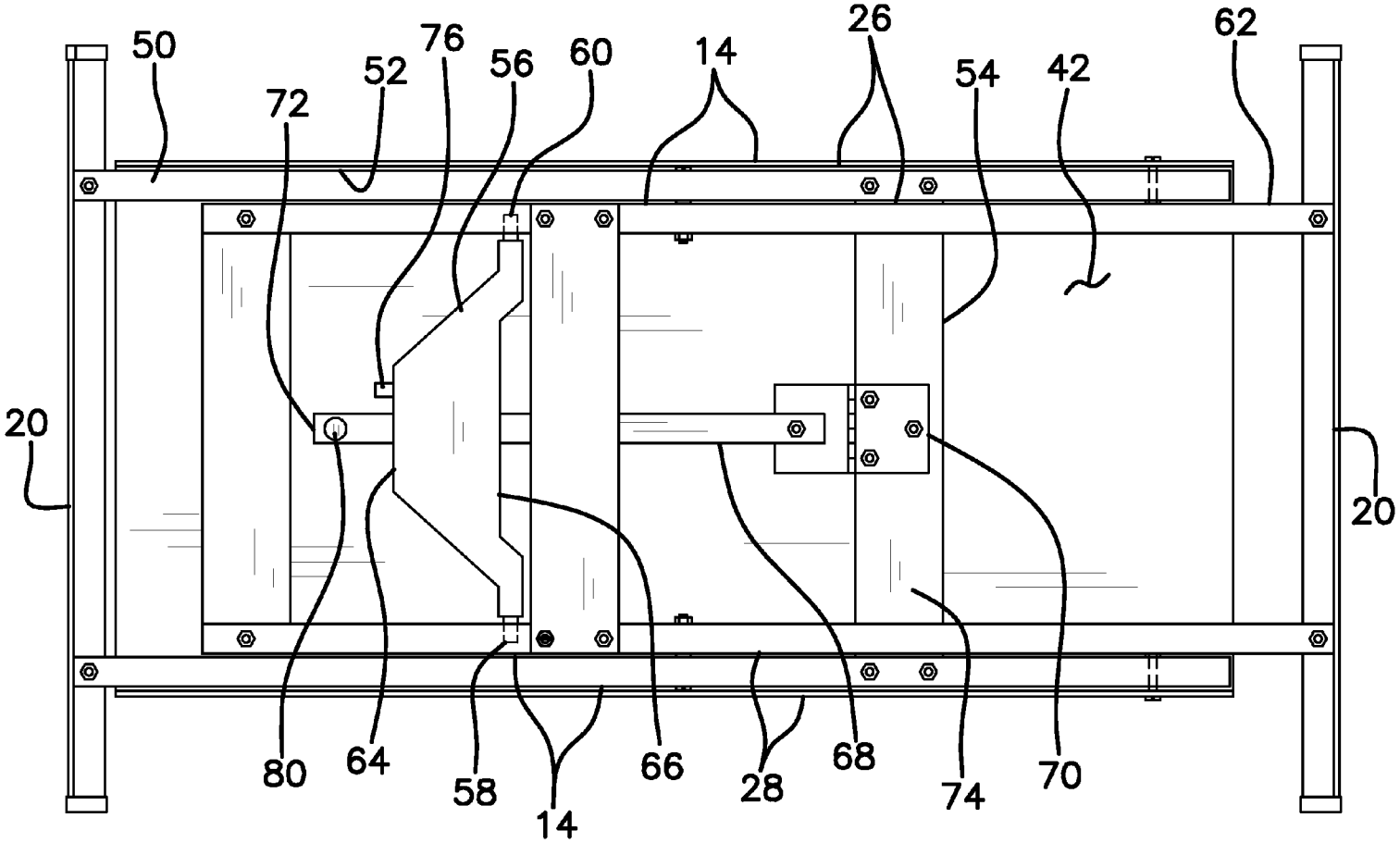
FIG. 5 is a bottom view of an embodiment of the disclosure.

With reference now to the drawings, and in particular to FIGS. 1 through 5 thereof, a new desk device embodying the principles and concepts of an embodiment of the disclosure and generally designated by the reference numeral 10 will be described.

As best illustrated in FIGS. 1 through 5, the portable desk assembly 10 generally comprises a pair of stands 12. The pair of stands 12 each includes a pair of longitudinal arms 14. Each of the pair of longitudinal arms 14 of the pair of stands 12 has a first end 16 and a second end 18. The first end 16 of each of the pair of longitudinal arms 14 of the pair of stands 12 is coupled to a lateral arm 20 of each of the pair of stands 12. Each of the pair of stands 12 each has a U-shape. The lateral arm 20 of each of the pair of stands 12 has a front end 22 and a back end 24. Each of the pair of longitudinal arms 14 of each of the pair of stands 12 is spaced inwardly from an associated one of the front 22 and back 24 ends of the associated one of each of the lateral arms 20 of the pair of stands 12.

Each of a first one 26 of the pair of longitudinal arms 14 of the pair of stands 12 is rotatably coupled together. Additionally, each of a second one 28 of the pair of longitudinal arms 14 of the pair of stands 12 is rotatably coupled together. The pair of stands 12 forms an X-shape when the pair of stands 12 are positioned in a deployed position. Moreover, the lateral arm 20 of each of the pair of stands 12 abuts a support surface 30. The second end 18 of each of the pair of longitudinal arms 14 of the pair of stands 12 is directed upwardly from the support surface 30. Each of the first longitudinal arms 26 of the pair of stands 12 is coextensive with one another and each of the second longitudinal arms 28 of the pair of stands 12 is coextensive with one another when the pair of stands 12 is positioned in a stored position.

A panel 32 is provided. The panel 32 has a primary end 34 and a secondary end 36. The panel 32 has an exterior edge 38 of the panel 32 extending between a top surface 40 and a bottom surface 42 of the panel 32. Each of a first lateral side 44 and a second lateral side 46 of the exterior edge 38 of the panel 32 is directed downwardly from the top surface 40 of the panel 32. A pair of lips 48 is defined on the panel 32.

The second end 18 of each of the pair of longitudinal arms 14 of a first one 50 of the pair of stands 12 is movably coupled to an inner surface 52 of an associated one of the pair of lips 48 on the panel 32. The second end 18 of the pair of longitudinal arms 14 of the first stand 50 is each positioned proximate the primary end 34 of the panel 32. The panel 32 lies flat on the pair of longitudinal arms 14 of each of the pair of stands 12 when the pair of stands 12 is positioned in the stored position. The panel 32 extends between the second end 18 of each of the pair of longitudinal arms 14 of each of the pair of stands 12 when the pair of stands 12 is positioned in the deployed position. The panel 32 is supported above the support surface 30 so the panel 32 may provide a work surface.

A primary arm 54 is provided. The primary arm 54 is coupled to and extends between the pair of longitudinal arms 14 of the first stand 50. The primary arm 54 is positioned proximate the second end 18 of each of the pair of longitudinal arms 14 of the first stand 50.

A lock 56 is provided. The lock 56 has a basic end 58 and an alternative end 60. Each of the basic 58 and alternative 60 ends of the lock 56 is rotatably coupled to an associated one of the pair of longitudinal arms 14 of a second one 62 of the pair of stands 12. The lock 56 is positioned proximate the second end 18 of each of the pair of longitudinal arms 14 of the second stand 62. A back edge 64 of the lock 56 extends rearwardly from a front edge 66 of the lock 56. Moreover, the lock 56 has an A-shape.

A slide arm 68 has a fixed end 70 and a sliding end 72. The fixed end 70 of the slide arm 68 is hingedly coupled to a lower side 74 of the primary arm 54. The fixed end 70 of the slide arm 68 is centrally positioned on the primary arm 54. The fixed end 70 of the slide arm 68 may have a width that is greater than a width of the sliding end 72 of the slide arm 68.

The sliding end 72 of the slide arm 68 extends through each of the front 66 and back 64 edges of the lock 56. The slide arm 68 is slidably coupled to the lock 56. The lock 56 engages the slide arm 68. The second end 18 of each of the pair of longitudinal arms 14 of each of the pair of stands 12 are retained a selected distance apart when the pair of stands 12 is positioned in the deployed position. The panel 32 is supported a selected distance above the support surface 30 when the lock 56 engages the slide arm 68.

A release 76 is movably coupled to the lock 56. The release 76 may be engaged by a user 78. The slide arm 68 is freely movable in the lock 56 while the release 76 is engaged by the user 78. The lock 56 engages the slide arm 68 when the release 76 is not engaged by the user 78 so the slide arm 68 is retained at a selected position in the lock 56.

A stop 80 is coupled to the sliding end 72 of the slide arm 68. The stop 80 abuts the back edge 64 of the lock 56 when the pair of stands 12 are positioned in the stored position. The stop 80 prevents the slide arm 68 from sliding out of the lock 56.

In use, the panel 32 is positioned in an extended position so the panel 32 extends upwardly from the first stand 50. The release 76 is engaged and the first 50 and second 62 stands are positioned in the deployed position. The first 50 and second 62 stands are positioned so the second ends 18 of each of the pair of longitudinal arms 14 of the pair of stands 12 are positioned at a selected distance above the support surface 30. The panel 32 is positioned in a lateral position so the bottom surface 42 of the panel 32 abuts the second end 18 of each of the pair of longitudinal arms 14 of the second stand 62. The pair of stands 12 are positioned in the stored position when the assembly 10 is not in use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A portable desk assembly configured to provide a work surface having an adjustable height, said assembly comprising:

a pair of stands each movably coupled together, said pair of stands being positionable between a deployed position and a stored position, said pair of stands each comprising a pair of longitudinal arms;

a panel coupled to said pair of stands wherein said panel is configured to provide the work surface;

a primary arm extending between said pair of longitudinal arms of a first one of said stands;

a lock coupled to and extending between said pair of longitudinal arms of a second one of said stands; and a slide arm having a fixed end relative to said primary arm, said slide arm having a sliding end opposite said fixed end, said fixed end of said slide arm being hingedly coupled to a lower side of said primary arm, said fixed end of said slide arm being centrally positioned on said primary arm, said slide arm being engaged by said lock wherein said lock retains said panel at a selected height when said pair of stands is positioned in said deployed position.

2. The assembly according to claim 1, further comprising each of said pair of longitudinal arms of said pair of stands having a first end and a second end, said first end of each of said pair of longitudinal arms of said pair of stands being coupled to a lateral arm of each of said pair of stands such that each of said pair of stands each has a U-shape.

3. The assembly according to claim 2, further comprising each of a first one of said pair of longitudinal arms of said pair of stands being rotatably coupled together, each of a second one of said pair of longitudinal arms of said pair of stands being rotatably coupled together.

4. The assembly according to claim 3, further comprising said pair of stands forming an X-shape when said pair of stands are positioned in said deployed position having said lateral arm of each of said pair of stands abutting a support surface, said second end of each of said pair of longitudinal arms of said pair of stands being directed upwardly from the support surface.

5. The assembly according to claim 3, wherein each of said first longitudinal arms of said pair of stands being coextensive with one another and each of said second longitudinal arms of said pair of stands being coextensive with one another when said pair of stands is positioned in said stored position.

6. The assembly according to claim 2, wherein a primary arm coupled to and extending between said pair of longitudinal arms of a first one of said pair of stands, said primary arm being positioned proximate said second end of each of said pair of longitudinal arms of said first stands.

7. The assembly according to claim 1, wherein said panel having a primary end and a secondary end, said panel having an exterior edge of said panel extending between a top surface and a bottom surface of said panel, each of a first lateral side and a second lateral side of said exterior edge of said panel being directed downwardly from said top surface of said panel such that a pair of lips is defined on said panel.

8. The assembly according to claim 7, further comprising a second end of each of a pair of longitudinal arms of a first one of said pair of stands being movably coupled to an inner surface of an associated one of said pair of lips on said panel, said second end of said pair of longitudinal arms of said first leg each being positioned proximate said primary end of said panel.

9. The assembly according to claim 8, further comprising said panel extending between said second end of each of said pair of longitudinal arms of each of said pair of stands when said pair of stands is positioned in said deployed position such that said panel is supported above the support surface.

10. The assembly according to claim 1, further comprising said sliding end of said slide arm extending through a front edge and a back edge of said lock such that said slide arm is slidably coupled to said lock, said lock being engageable to said slide arm at a selectable position on said slide arm such that said slide arm is inhibited from sliding relative to said lock wherein said pair of stands are held in a static position relative to each other.

11. The assembly according to claim 10, further comprising said panel being supported a selected distance above the support surface when said lock engages said slide arm.

12. A portable desk assembly configured to provide a work surface having an adjustable height, said assembly comprising:

a pair of stands each movably coupled together, said pair of stands being positionable between a deployed position and a stored position;

a panel coupled to said pair of stands wherein said panel is configured to provide the work surface;

a primary arm extending between said pair of longitudinal arms of a first one of said stands;

a lock coupled to and extending between a pair of longitudinal arms of a second one of said stands;

each of said pair of longitudinal arms of said pair of stands having a first end and a second end, said first end of each of said pair of longitudinal arms of said pair of stands being coupled to a lateral arm of each of said pair of stands such that each of said pair of stands each has a U-shape; and said lock having a basic end and an alternative end, each of said basic and alternative ends of said lock being coupled to an associated one of said pair of longitudinal arms of said second one of said pair of stands, said lock being positioned proximate said second end of each of said pair of longitudinal arms of said second leg.

13. A portable desk assembly configured to provide a work surface having an adjustable height, said assembly comprising:

a pair of stands each comprising a pair of longitudinal arms, each of said pair of longitudinal arms of said pair of stands having a first end and a second end, said first end of each of said pair of longitudinal arms of said pair of stands being coupled to a lateral arm of each of said pair of stands such that each of said pair of stands each has a U-shape, each of a first one of said pair of longitudinal arms of said pair of stands being rotatably coupled together, each of a second one of said pair of longitudinal arms of said pair of stands being rotatably coupled together, said pair of stands forming an X-shape when said pair of stands are positioned in a deployed position having said lateral arm of each of said pair of stands abutting a support surface, said second end of each of said pair of longitudinal arms of said pair of stands being directed upwardly from the support surface;

each of said first longitudinal arms of said pair of stands being coextensive with one another and each of said second longitudinal arms of said pair of stands being coextensive with one another when said pair of stands is positioned in a stored position;

a panel having a primary end and a secondary end, said panel having an exterior edge of said panel extending between a top surface and a bottom surface of said panel, each of a first lateral side and a second lateral side of said exterior edge of said panel being directed downwardly from said top surface of said panel such that a pair of lips is defined on said panel;

said second end of each of said pair of longitudinal arms of a first one of said pair of stands being movably coupled to an inner surface of an associated one of said pair of lips on said panel, said second end of said pair of longitudinal arms of said first stand each being positioned proximate said primary end of said panel;

said panel extending between said second end of each of said pair of longitudinal arms of each of said pair of stands when said pair of stands is positioned in said deployed position such that said panel is supported above the support surface wherein said panel is configured to provide the work surface;

a primary arm coupled to and extending between said pair of longitudinal arms of said first stand, said primary arm being positioned proximate said second end of each of said pair of longitudinal arms of said first stand;

a lock having a basic end and an alternative end, each of said basic and alternative ends of said lock being coupled to an associated one of said pair of longitudinal arms of a second one of said pair of stands, said lock being positioned proximate said second end of each of said pair of longitudinal arms of said second stand;

a slide arm having a fixed end relative to said primary arm, said slide arm having a sliding end opposite said fixed end, said fixed end of said slide arm being hingedly coupled to a lower side of said primary arm, said fixed end of said slide arm being centrally positioned on said primary arm, said slide arm being engaged by said lock wherein said lock retains said panel at a selected height when said pair of stands is positioned in said deployed position; and said sliding end of said slide arm extending through a front edge and a back edge of said lock such that said slide arm is slidably coupled to said lock, said lock being engageable to said slide arm at a selectable position on said slide arm such that said slide arm is inhibited from sliding relative to said lock wherein said pair of stands are held in a static position relative to each other, said panel being supported a selected distance above the support surface when said lock engages said slide arm.

* * * * *